United States Patent [19]

Rozner et al.

[11] 4,434,702

[45] Mar. 6, 1984

[54] TELESCOPING PERISCOPE

[75] Inventors: Marvin J. Rozner, Ventura; Arthur S. Chapman, Santa Barbara County, both of Calif.

[73] Assignee: The United States of America as represented by the Secretary of the Army, Washington, D.C.

[21] Appl. No.: 356,002

[22] Filed: Mar. 8, 1982

[51] Int. Cl.[3] ..... F41G 1/40

[52] U.S. Cl. ..... 89/36 L; 89/36 M; 350/544

[58] Field of Search ..... 89/36 L, 36 M, 38, 41 E; 350/500, 539, 540, 541, 542, 543, 544

[56] References Cited

U.S. PATENT DOCUMENTS 1,624,733 4/1927 Humbrecht ..... 350/544

3,762,795 10/1973 Bezu ..... 350/539

4,326,446 4/1982 Magnuson ..... 89/38

*Primary Examiner*—Stephen C. Bentley

*Attorney, Agent, or Firm*—Peter A. Taucher; John E. McRae; Robert P. Gibson

[57] ABSTRACT

A periscope for a military land vehicle to provide observation capability over hills or other obstacles. The periscope includes two telescopic tubes movable at different rates to position a sight head assembly at different elevated positions; a relatively large movement of the head assembly is achieved even though the vehicle has a relatively low silhouette. The sight head asembly includes two connected heads individually movable in the azimuth and elevational planes to provide complete scan of the terrain and airborne objects. The Commander of the vehicle can control the periscope while seated in one position, as necessary in a vehicle having very limited personnel space.

2 Claims, 3 Drawing Figures

TELESCOPING PERISCOPE

GOVERNMENT INTEREST

The invention described herein may be manufactured, used, and licensed by or for the Government for governmental purposes without payment to use of any royalty thereon.

BACKGROUND AND SUMMARY OF THE INVENTION

This invention relates to a periscope usable in a land military vehicle to provide increased visibility over hills or obstacles that would otherwise shield enemy targets from view. The periscope has the following general features:

1. variable height adjustment for retraction to a concealed position or raising to required viewing height.
2. a fixed eyepiece location for all periscope heights and viewing directions, whereby the tank commander can remain seated in one stationary position.
3. a constant fixed optical system path length in all periscope positions for maintaining a continuous sharp focus on the target scene.
4. inertial stabilization of the sighting head at the upper end of the periscope to minimize jitter of the image while the vehicle is moving over rough terrain.
5. reticle plate location in the sighting head at the upper end of the periscope for maintaining crosshair positionment on the optical axis in spite of flexure movements of the periscope mast structure.
6. a relatively large periscope extension length for a given height vehicle.

THE DRAWING

Figure 1:
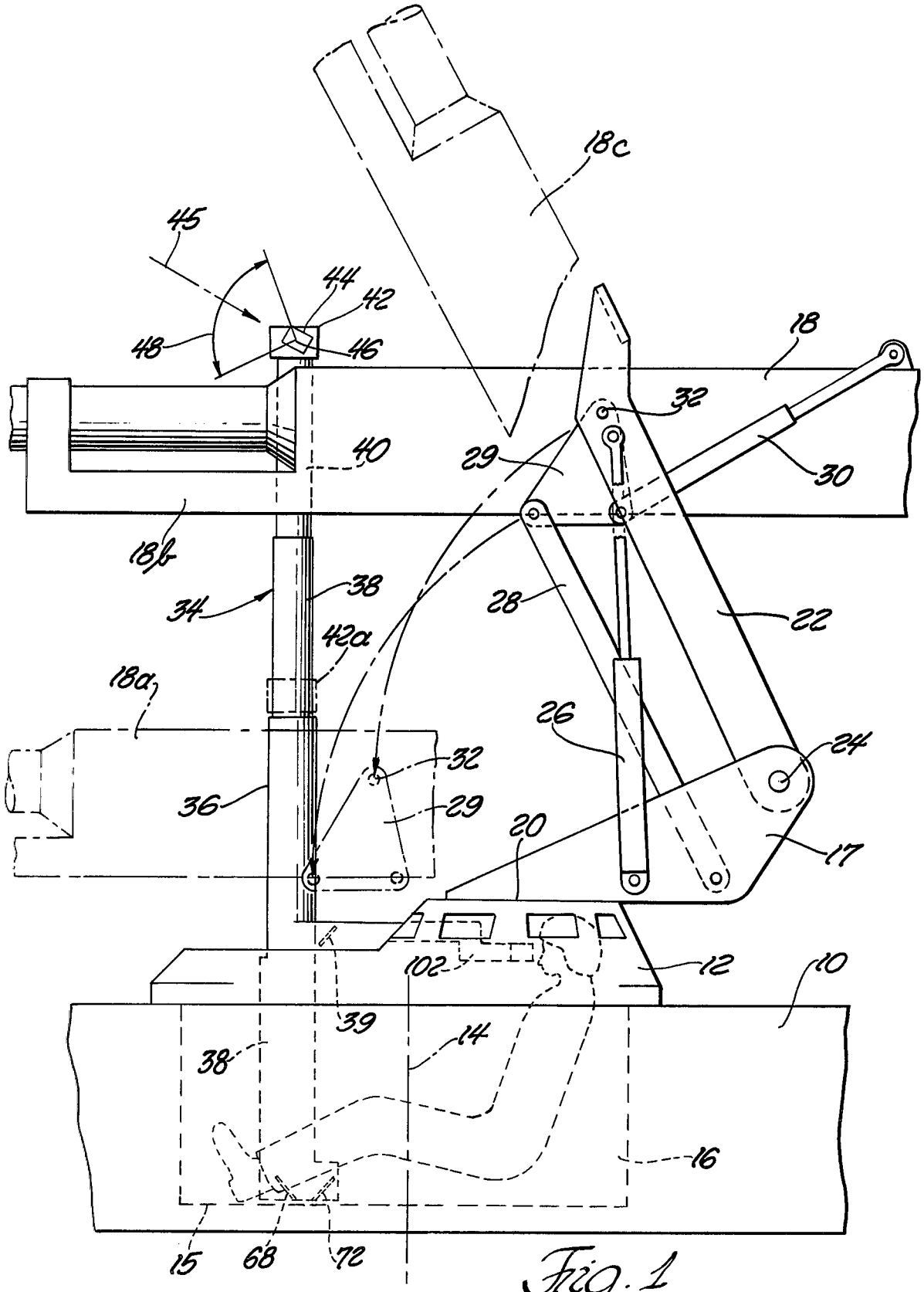
FIG. 1 is a fragmentary side elevational view of a military vehicle incorporating our invention.

Referring in greater detail to FIG. 1, there is fragmentarily shown a military tank comprising a hull 10 having a rotary turret 12 mounted therein for rotation in the azimuth plane around central axis 14; the turret carries a depending basket 16 that accommodates two soldiers in semi-prone seated positions normally facing the area in the path being taken by the tank (except when the turret is rotated). The driver of the vehicle is positioned in the hull forwardly from the turret.

This particular tank includes a bracket 17 projecting upwardly from the turret for mounting main gun 18 in the space above turret roof 20. The gun is not part of our invention except that we have designed our periscope to be especially useful on a vehicle having this type gun. The gun is carried on an arm 22 that swings around a pivot 24 to locate the gun in a lowered prone position 18*a*, a raised prone position 18*b*, or various intermediate prone positions, not shown; a hydraulic cylinder 26 provides the motive force. A link 28 interacts with a triangular link 29 to normally maintain the gun in a prone position during operation of cylinder 26. However, for changing the elevational firing angle of the gun a second hydraulic cylinder 30 is trained between link 29 and the gun; numeral 18*c* illustrates the gun swung around pivot 32 into an inclined attitude or firing angle. Cylinder 30 may be actuated at the same time as cylinder 26 or afterward. The gun system is generally designed for use on land targets or airborne targets. Elevation of the gun from position 18*a* to position 18*b* enables the gun to be fired over hills or obstacles without exposing the entire vehicle to enemy view or direct attack. Cylinder 30 targets the gun in the elevational plane; turret 12 rotation targets the gun in the azimuth plane.

As previously noted, our invention is directed especially to a periscope, identified in FIG. 1 by numeral 34. The periscope includes a stationary support tube 36 rigidly affixed to the roof area of turret 12 in a location offset from the gun centerline; two slidable tubes 38 and 40 are telescopically mounted in tube 36. The innermost tube 40 carries a main head 42 at its upper end; a second smaller sighting head 44 is carried on the main head. In the head position shown in FIG. 1 head 44 receives a light beam along pathline 45; the beam is redirected ninety degrees into head 42, thence turned ninety degrees into tubes 40 and 38. A mirror system 68, 72 at the lower end of tube 38 redirects the light beam upwardly to a stationary reflector 39 (FIG. 2) that is optically connected to an eye piece 41.

Tubes 40 and 38 are adjustable in the vertical direction, but not in the rotational (horizontal) direction. Scanning in the azimuth plane is accomplished by turning head 42 around the tube 40 axis, using a small torquer motor in the head. Scanning in the elevational plane is accomplished by turning head 44 around transverse horizontal axis 46. Numeral 48 designates generally the useful adjustment range in the elevational plane.

Tubes 38 and 40 may be simultaneously moved to position head 42 in the elevated position shown in full lines in FIG. 1 or the dashed line lowered position 42*a*. Various intermediate positions are possible, depending on the target location. An elevated position of head 42 provides a view of the scene beyond or behind a hill or other obstacle without exposing the entire vehicle to enemy fire. The periscope is used primarily as a surveillance device to locate a target or determine the hit-miss distance. Periscope scanning can be done without moving gun 18; scanning is therefore potentially a very quick operation carried out while the gun is firing at a previously selected target. The gun may be equipped with its own conventional sight separate from periscope 34.

The periscope is preferably sized so that the upper end of support tube 36 is approximately level with the upper surface of gun 18 when the gun is in its lowered prone position. Heads 42 and 44 are then just above the gun surface for scanning across the entire horizon without obstruction by the gun. The upstroke of the telescopic tube means 38, 40 is preferably sufficient to cause head 42 to be just above the gun when the gun is in its raised prone position 18*b*, thus permitting three hundred sixty degree scan in the azimuth plane.

Figure 2:
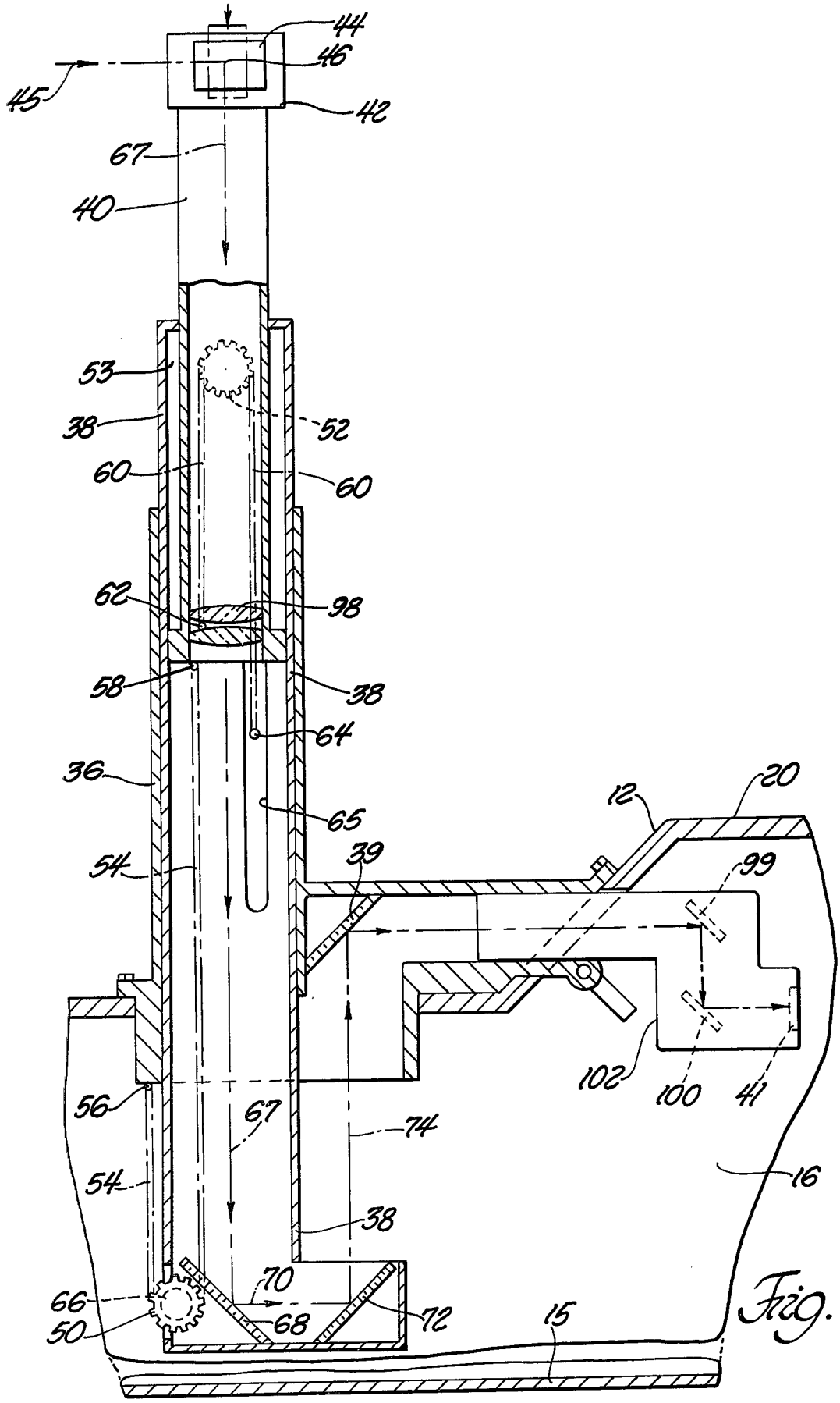
FIG. 2 is a sectional view of a periscope structure used in the FIG. 1 vehicle.

The mechanism for raising and lowering the periscope is preferably designed so that tube 40 moves twice as fast as tube 38 in order to provide a constant length optical path in all positions of heads 42 and 44. The raise-lower mechanism may be hydraulic in nature. The illustrated mechanism shown in FIG. 2 is mechanical in nature. It comprises a first sprocket 50 mounted in the lower end of tube 38, and a second sprocket 52 mounted on the upper end of tube 38 in clearance space 53. A chain 54 extends downwardly from a fixed anchorage 56 around sprocket 50 and thence upwardly to an anchorage 58 on tube 40. A second chain 60 extends upwardly from anchorage 62 on tube 40 around sprocket 52, thence downwardly to a fixed anchorage 64 on stationary support tube 36; a slot 65 is formed in tube 38 to permit vertical motion of tube 38 without obstruction by anchorage 64.

A reversible motor 66 is located at the lower end of tube 38 to drive sprocket 50. Counterclockwise motion of sprocket 50 causes tube 38 to move upwardly in stationary tube 36. Sprocket 52 moves bodily upwardly with tube 38; the section of chain 60 connected to anchorage 64 is placed in tension to thereby produce clockwise rotation of sprocket 52. Sprocket 52 rotation draws the other section of chain 60 upwardly so that tube 40 is drawn upward relative to tube 38. The absolute movement speed of tube 40 is twice that of tube 38.

Tubes 40 and 38 are lowered by operating motor 66 in the clockwise direction. Sprocket 50 turns clockwise to move downwardly on chain 54. Sprocket 52 moves bodily downward with tube 38 and also rotates counterclockwise to produce a lowering motion of tube 40. Absolute downward motion speed of tube 40 is twice that of tube 38. The tubes are sized so that when head 42 is in its lowermost position 42*a* (FIG. 1) the lower end of tube 38 will be at or only slightly above floor 15 of turret basket 16.

The raise-lower system for tubes 38 and 40 is designed to provide a constant length U-shaped optical path between head 42 and mirror 39 irrespective of the head 42 elevation. A constant length optical path is advantageous for maintaining a continuous sharp focus on the target scene. The U-shaped optical path includes a relatively long path section 67 between head 42 and mirror 68, a short transverse path section 70 between mirrors 68 and 72, and an intermediate length path section 74 between mirror 72 and stationary reflector 39. During upward motion of tubes 38 and 40 path section 67 increases in length while path section 74 decreases in length; the length increase in path 67 is exactly the same as the length decrease in path 74 because tube 40 moves at twice the speed of tube 38. During downward motion of tubes 38 and 40 path section 67 undergoes a length decrease while path section 74 undergoes the same length increase. The length of the U-shaped optical path remains constant for all positions of head 42.

Figure 3:
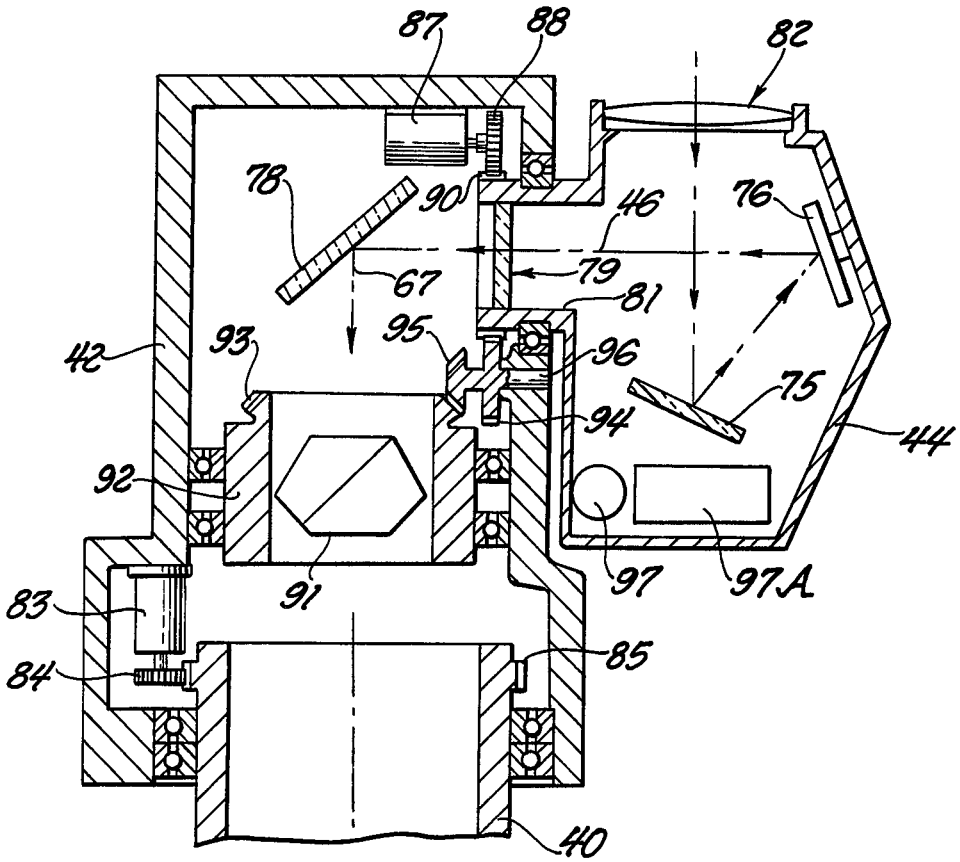
FIG. 3 is an enlarged sectional view of a sight head assembly located at the upper end of the FIG. 2 periscope.

FIG. 3 schematically illustrates a simplified version of a visible light optical system for transmitting an optical image from sight head 44 into head 42 and thence downwardly through tube 40 along aforementioned pathline 67. The simplified mechanism of FIG. 3 comprise two mirrors 75 and 76 that collectively redirect an incoming beam along the aforementioned transverse axis 46 to a mirror 78 in head 42; mirror 78 redirects the beam downwardly along pathline 67. A transparent reticle plate 79 is mounted in a circular collar or neck section 81 of head 44 on the optical axis 46; a cross hair in the reticle plate provides a reference center for the target image received by the entrance lens system 82 in head 44. Various magnification lenses (not shown) may be located in head 44 to provide selective magnification of the image received by lens system 82.

Head 42 may be rotated in the azimuth plane around the axis of tube 40 by means of a motor 83 that drives a pinion gear 84 engaged with a ring gear 85 carried by tube 40; a slip ring system (not shown) supplies electrical energy to motor 83. Head 44 may be rotated in the elevational plane around transverse axis 46 by means of a motor 87 that drives a pinion gear 88 engaged with a ring gear 90 carried by collar 81. Separate control lines will be connected to the slip ring system to permit selective energization of motors 83 and 87, as necessary to achieve desired scan action in the azimuth and elevational planes. The tube system 38, 40 has motion capability up and down, but no rotational capability.

To prevent undesired rotation of the optical image when motor 83 and/or motor 87 is/are operating the optical system may be equipped with a derotation prism 91 suitably mounted in a sleeve 92 that is equipped with a bevel gear 93. The rotation of prism 91 is required to be one half the speed of the algebraic sum of the rotational speeds of the two heads 42 and 44 about their respective axes; the rotational directions are such that image rotation about the optical line of sight in cancelled. Various gear train systems or direct electrical drives may be utilized to accomplish the desired motions. The system shown in FIG. 3 comprises a large idler gear 94 and small idler gear 95 affixed to a stem 96 for joint rotation on the wall of head 42. Gear 94 is engaged with aforementioned ring gear 90, whereas gear 95 is engaged with gear 93. Assuming that gear 93 has the same diameter as gear 90, the diameter of gear 94 should then be twice that of gear 95, whereby rotation of head 44 around axis 46 or rotation of head 42 around the axis of tube 40 produces a rotation of prism 91 sufficient to keep the reticle plate 91 image erect, i.e. not rotated, on mirror 78. The action of gears 94 and 95 is similar to that of certain derotation gearing shown in U.S. Pat. No. 3,309,962 to Lykam (see especially gears 106 and 104 of that patent).

Sight head 44 may, if desired, be equipped with inertial stabilization mechanisms to minimize jitter of the optical image while the vehicle is moving over rough terrain. As shown in FIG. 3, the stabilization mechanism comprises a gyroscopes 97 and 97*a* mounted in head 44 to generate electrical signals responsive to rotational movements of head 44 associated with rough terrain motions of the vehicle in two planes. Gyroscope output signals would be transmitted to motors 87 and 83, which would then provide counteracting torques tending to maintain head 44 in its desired attitude in space. The stabilization system helps to prevent blur of the optical image while the vehicle is traversing rough terrain.

The complete optical system comprises mirrors 75, 76 and 78, prism 91, magnification lens system 98 at the lower end of tube 40, mirrors 68 and 72, reflector 39, and optical elements 99 and 100 in the adjustable scope 102. An image intensifier, not shown, may be provided between element 100 and eyepiece 41 if desired or necessary.

A feature of special interest is the fixed location of eyepiece 41 in all periscope positions, whereby the tank commander can remain seated in one stationary position during periscope elevational movements, and scan activities in the azimuth and elevational planes, without rotating the basket 16. A fixed eyepiece 41 location is made possible by the fact that tubes 38 and 40 are nonrotatable devices. Heads 42 and 44 are selectively rotatable in the azimuth and elevational planes. Derotation mechanism 91, 94 and 95 in head 42 prevent image rotation effects as would interfere with usefulness of the periscope system.

Another feature of special interest is the periscope raise-lower mechanism that effects simultaneous movements of two tubes 38 and 40, to achieve a relatively large total motion of sight head 42 for a given height turret 12.

Military considerations on low tank silhouette and weight limitations favor a low tank height; the raise-lower mechanism of FIG. 2 achieves fairly large periscope elevational motion even though the turret has a relatively small vertical dimension. The raise-lower mechanism is further advantageous in that it maintains a constant length optical path from sight head 42 to stationary reflector 39 in all head 42 elevations; this feature gives the optical system a capability for good focus on the target scene.

We wish it to be understood that we do not desire to be limited to the exact details of construction shown and described for obvious modifications will occur to a person skilled in the art.

We claim:

1. In a military vehicle having a turret rotatable in the azimuth plane, a main gun externally mounted on the roof of the turret, first power means for moving the gun bodily between a lowered prone position adjacent the turret roof and a raised prone position remote from the turret roof, and second power means for swinging the gun around a first horizontal axis to vary the elevational firing angle of the gun: the improvement comprising a periscope extending upwardly from the turret in the space alongside the gun;

said periscope including a first stationary support tube extending upwardly from the turret roof to a point near the upper surface of the gun when the gun is in its lowered prone position, a second tube telescopically slidably extendable from the stationary support tube, a third tube slidably telescopically extendable from the second tube, a first head carried on the upper end of the third tube for three hundred sixty degree movement in the azimuth plane, the second and third tubes being movable between lowered positions wherein the first head is slightly above the gun in its lowered prone position to raised positions wherein the first head is slightly above the gun in its raised prone position;

said periscope further including a second head carried on the first head for angular motion around a second horizontal axis normal to the tube axis, optical elements within the first and second heads for transmitting an image from the second head along the second horizontal axis and thence downwardly along the tube axis, and mirror means at the lower end of the second tube for receiving the image from the first head and reflecting said image upward parallel to the tube axis;

a stationary reflector arranged to receive the upwardly directed beam from the mirror means;

and power means for simultaneously moving said second and third tubes at different speeds such that the first head and mirror means move away from each during the raise motion of the periscope and toward each other during lowering motion of the periscope, the movement speed of the third tube being one half the movement speed of the inner tube so that the optical path from the second head to the stationary reflector has a constant length in all adjusted positions of the second and third tubes;

said power means comprising a first sprocket mounted on the second tube near its lower end, a second sprocket mounted on the second tube near its upper end, a first chain extending from a fixed anchorage downwardly around the first sprocket and thence upwardly to an anchorage on the third tube, and a second chain extending from an anchorage on the third tube upwardly around the second sprocket and thence downwardly to an anchorage on the stationary support tube.

2. The combination of claim 1 wherein the power means comprises a motor carried by the second tube in operative driving relation to the first sprocket.

* * * * *